United States Patent [19]

Brock et al.

[11] 4,185,348

[45] Jan. 29, 1980

[54] APPARATUS FOR REMOVING TRIM RINGS FROM COMPOSITE CANS

[75] Inventors: James E. Brock; Cara M. Gentry; Ray DeUnger, all of Orlando, Fla.

[73] Assignee: Citrus Central, Incorporated, Orlando, Fla.

[21] Appl. No.: 921,473

[22] Filed: Jul. 3, 1978

[51] Int. Cl.[2] ..... B08B 9/08; B08B 11/02

[52] U.S. Cl. ..... 15/101; 15/71; 15/88; 15/97 R

[58] Field of Search ..... 15/56, 60, 62, 63, 70–72, 15/75, 88, 101, 104.05, 104.16, 104.2; 134/8

[56] References Cited

U.S. PATENT DOCUMENTS

| | | | |
|---|---|---|---|
| 1,173,255 | 2/1916 | Eberhart | 15/71 |
| 1,622,902 | 3/1927 | Brosius | 15/104.16 |
| 2,262,697 | 11/1941 | Pearson | 15/71 X |

*Primary Examiner*—Edward L. Roberts

*Attorney, Agent, or Firm*—Duckworth, Hobby & Allen

[57] ABSTRACT

Apparatus and a method for removing foreign and undesirable material from composite cans during the manufacturing operation includes a first conveyor having spindles thereon for indexing the cans on the first conveyor in a space parallel relation with an open end thereof faced in a direction substantially transverse to the direction of conveyance. A second conveyor is positioned alongside the first conveyor, and is positively controlled with, and driven with the first conveyor in the same direction at a uniform rate. A plurality of plungers are provided parallel to the cans and carried by the second conveyor, and a cam arrangement drives the plungers toward, through and away from the cans in order to pass the end of each plunger through a corresponding can to remove any foreign or undesirable materials therefrom.

20 Claims, 3 Drawing Figures

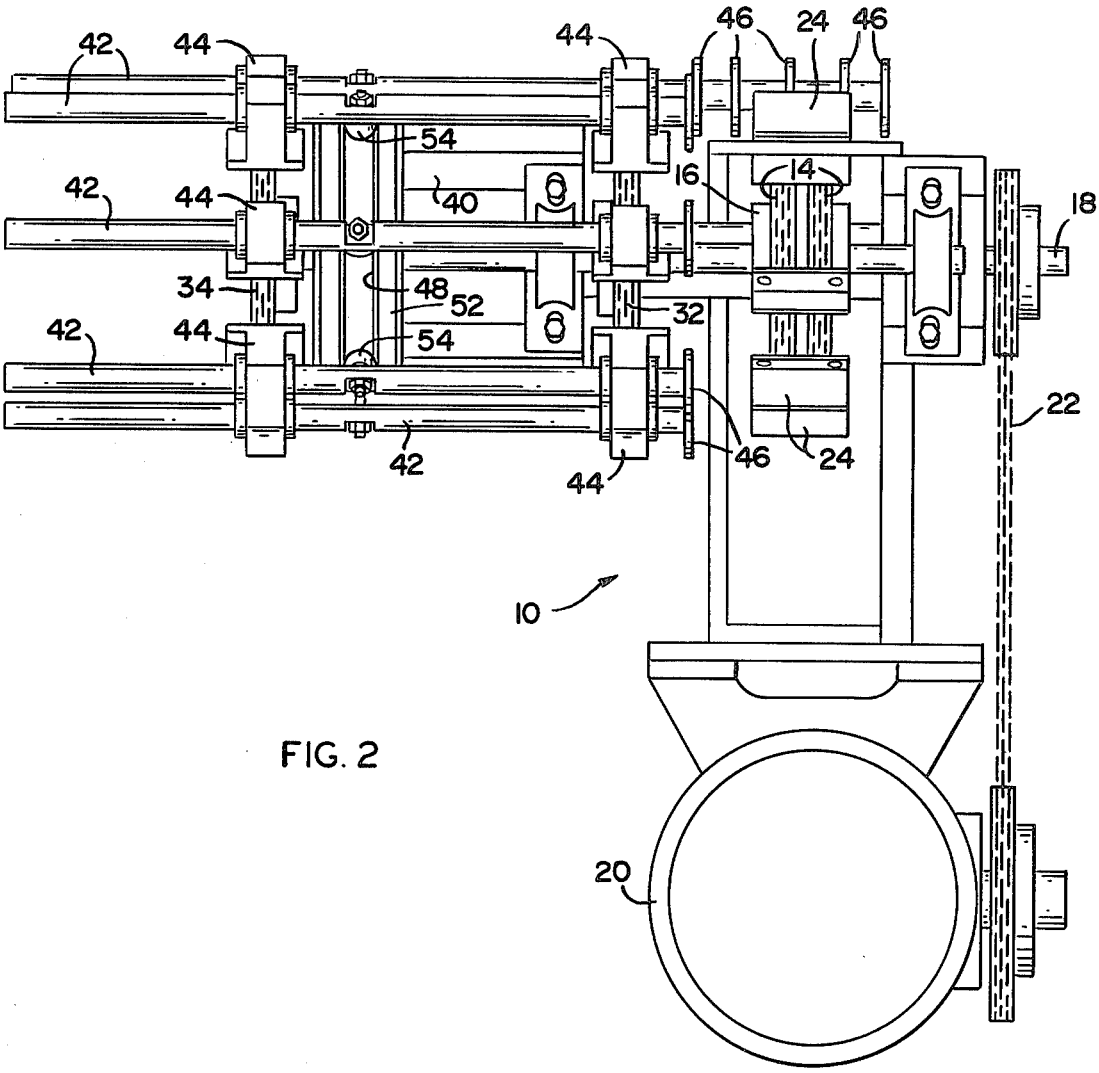
FIG. 2
FIG. 3
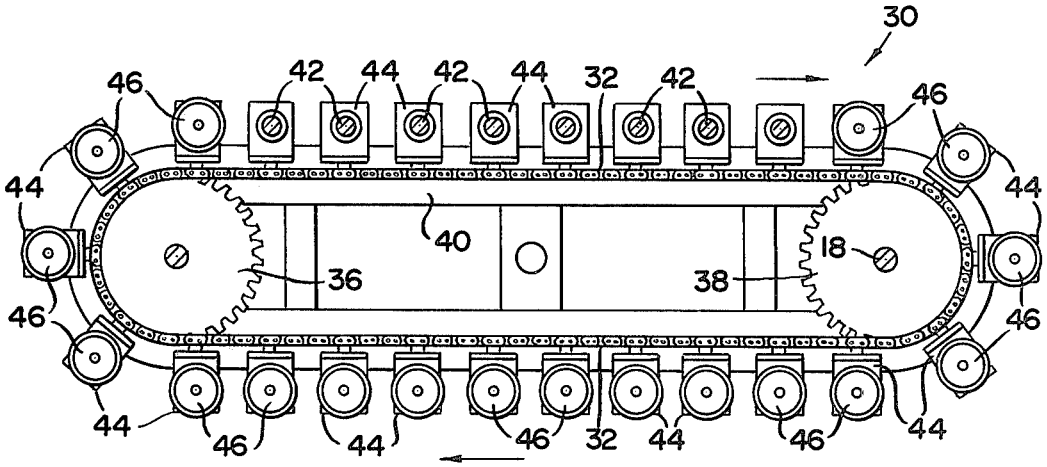

APPARATUS FOR REMOVING TRIM RINGS FROM COMPOSITE CANS

BACKGROUND OF THE INVENTION

1. Field of the Invention

The present invention relates to apparatus and methods useful in the spiral winding and cutting of paper tubes to form composite cans, and in particular, relates to apparatus and methods useful in removing foreign and undesirable materials from the can after the winding and cutting operations.

2. Description of the Prior Art

Numerous prior art patents suggest apparatus and methods for winding a strip of heavy paper into a tube around a mandrel, winding and glueing a labeling strip onto the tube, and then cutting the tube into specified lengths. See, for example, the following U.S. Pat. Nos.: 3,133,483 (Glassey); and 2,712,778 (Robinson).

After the tube is cut into the prescribed length, each length is provided with a bottom, the container is filled with a consumable product (such as concentrated citrus juice, for example) and a removable top is affixed to the open end. This type of container is commonly referred to as a "composite can".

Many millions of such composite cans are required to satisfy the demands of the marketplace. Therefore, the manufacture of these cans must necessarily be accomplished at high production rates. Thus, a typical composite can tube winding machine will manufacture on the order of about one hundred and fifty thousand cans per day.

As described in the above-mentioned patents, it is necessary to provide some means of indexing the cutting operation, in order to insure that each can is cut to the same prescribed length. Some commercially available composite can tube winding machines accomplish this by providing a so-called "trim ring" cutting operation wherein each can is trimmed at one end to insure that each can is of the same length. The result of this operation is a narrow ring of scrap material.

In order to prevent this trim ring scrap from remaining with, or in the can, it is customary to force a high-velocity stream of air across the can following the trimming operation. Nevertheless, an occasional trim ring becomes lodged in the can, and remains there during the closure and sealing operations, to be discovered by the consumer when the can is opened. While the number of such defects is extremely small, on the order of less than 00.2% of manufactured composite cans, the inevitable expressions of consumer concern and concomitant loss of product goodwill represents a substantial economic loss.

There are several prior art patents which suggest techniques for cleaning foreign and undesirable materials from containers during the manufacturing operation.

In U.S. Pat. No. 1,173,255, Eberhart discloses apparatus employing brushes which are moved into the cans in a synchronous fashion.

U.S. Pat. No. 2,262,697 to Pearson discloses a metal can cleaning machine for removing solder in which the cleaning mechanism is aligned with the can and then rotated through the can for cleaning the internal surface.

Other prior art patents of interest include: U.S. Pat. Nos. 3,490,404 (Vanderlaan et al); 2,327,986 (Bach); 3,881,436 (Paumier et al); 3,983,729 (Traczyk et al); 2,295,595 (Gladfelter).

SUMMARY OF THE INVENTION

The present invention contemplates apparatus and an associated method for removing foreign and undesirable materials from a plurality of open-ended lengths of hollow tubing, in which the apparatus comprises a first conveyor for transporting the plurality of tubes in a first direction and means for indexing the tubes on the conveyor in spaced, parallel relation with an open end of all of the tubes facing in a direction which is substantially transverse to the first direction.

The apparatus further includes a second conveyor positioned alongside the first conveyor, and positive drive means coupled for driving both the first and second conveyors at a uniform rate in a first direction. The apparatus is provided with a plurality of plungers parallel to the can and carried by the second conveyor, with means for moving the plungers through the tubes during uniform movement of the first and second conveyors in the first direction.

In a preferred embodiment of the present invention, the moving means comprises a fixed cam race extending parallel with, and in the plane of the second conveyor and having a bend therein in the direction of the conveyor, with each plunger including a roller attached thereto engaging the cam race, such that the plungers move toward and away from the first conveyor during movement of the plungers with the second conveyor. In accordance with another aspect of the present invention, the indexing means associated with the first conveyor comprises a plurality of spaced spindles fixed to the first conveyor with each spindle adapted to engage one of the tubes during movement with the first conveyor. It will be understood that the positive drive means interconnecting the first and second conveyors and the plungers are positioned such that plungers may accurately index with an associated cam during movement through the cam.

Another feature of the preferred embodiment of the present invention is the utilization of a pair of spaced, endless drive chains which serve the function of the second conveyor. These drive chains are provided with a plurality of bearing members fixed along each endless drive chain, the bearing members being disposed in opposing pairs with one bearing member of each pair being carried by one of the drive chains. Each plunger is movably supported by one of the pairs of bearing members, so as to reciprocally move toward and away from the first conveyor as the cam roller fixed to the associated plunger is moved through the cam race, and along the bend therein.

THE DRAWING

FIG. 2 is an end view of the apparatus shown in FIG. 1.

FIG. 3 is a cross sectional side view of a portion of the apparatus shown in FIG. 1, taken along line 3—3.

DESCRIPTION OF THE PREFERRED EMBODIMENT

Figure 1:
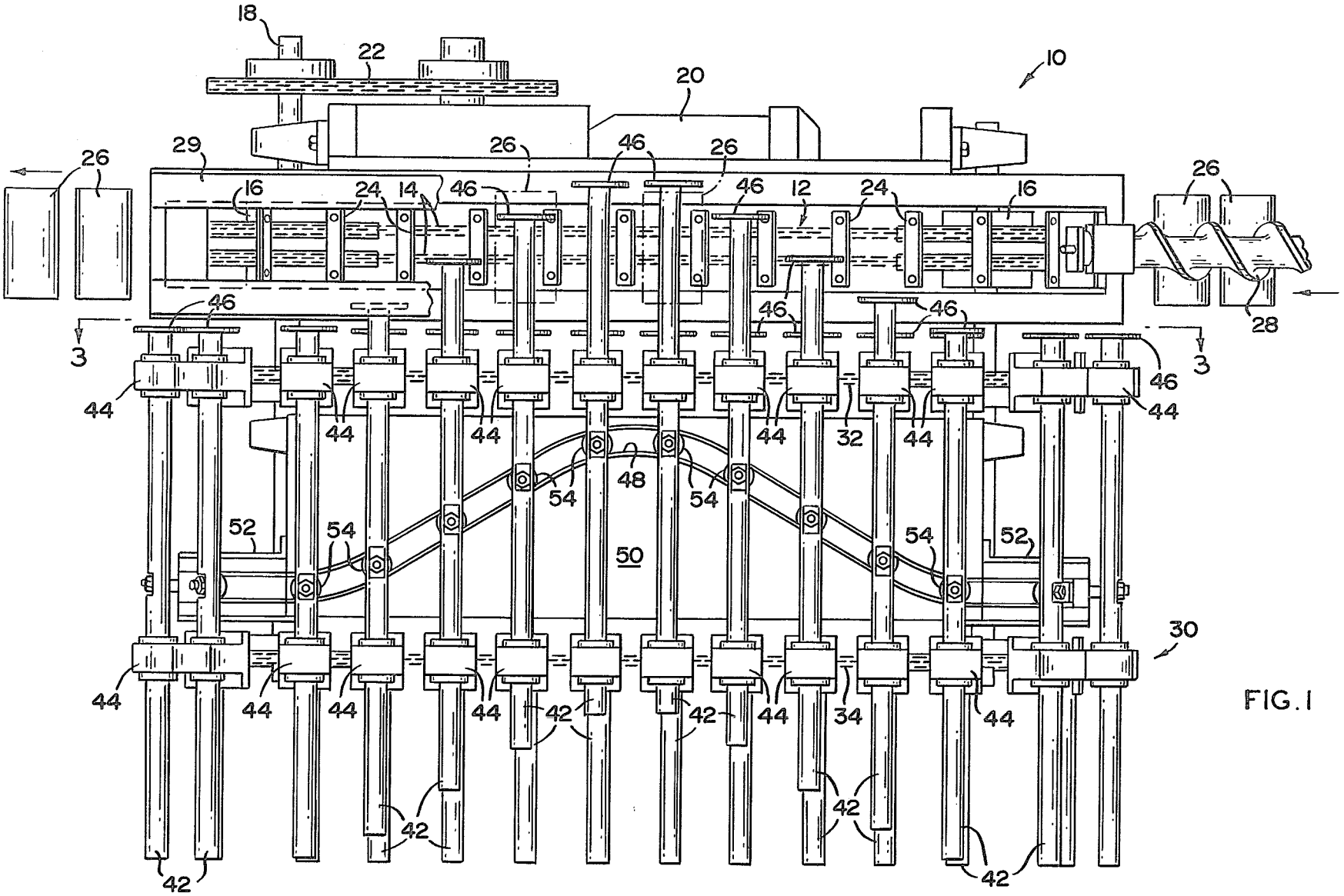
FIG. 1 is a top plan view of a preferred embodiment of apparatus in accordance with the present invention.

The preferred embodiment of the present invention will now be described with reference to FIGS. 1, 2 and 3.

Can cleaning apparatus in accordance with the present invention is referred to generally by the reference number 10 in each of FIGS. 1 and 2. The apparatus includes a first conveyor 12 defined by a pair of endless chain link belts 14, which are wrapped about opposing sprockets 16. One of the sprockets 16, on the left hand side of FIG. 1, is commonly mounted for positive rotation with a drive shaft 18. The shaft 18 is driven by a motor 20 via a drive chain 22. Mounted across the pair of chain link belts 14 is a plurality of spaced, parallel indexing spindles 24. The space between adjacent indexing spindles 24 is determined by the size of the cans 26 which are to be cleaned. It will be understood that each can abuts one of the spindles 24 as the first conveyor 12 moves in a first direction (from right to left in FIG. 1). The apparatus 10 is provided with an Archmides Screw 28 which is adapted to space the cans 26 and feed them onto the first conveyor 12 in a conventional manner. A grid 29 is fixed over the first conveyor 12 to hold the cans 26 against the two endless chain link belts 14.

The apparatus 10 is further provided with a second conveyor assembly, which includes means for cleaning the cans of foreign and undesirable materials during passage of the cans 26 with the conveyor 12 in the first direction. In accordance with this preferred embodiment, this second conveyor assembly is defined by a pair of spaced, endless drive chains 32 and 34. Each endless drive chain 32, 34 of the second conveyor assembly is wrapped about a pair of drive sprockets 36, 38, one of the two sprockets 38 being commonly mounted for rotation with the shaft 18 and the sprocket 16 associated with the first conveyor 12. In this manner, both the first conveyor 12 defined by the chain link belts 14 and the second conveyor assembly defined by the pair of spaced, endless drive chains 32, 34 are driven at a uniform rate along the first direction.

The second conveyor assembly is further provided with a plurality of plungers 42, each of which is parallel with the cylindrical axis of the cylindrical cans 26 being carried by the first conveyor 12, each plunger 42 further being movably attached to the pair of spaced endless drive chains 32, 34. To facilitate this, each drive chain 32, 34 is provided with a plurality of bearing members 44, each bearing member being attached to a respective one of the drive chains 32, 34. The bearing members 44 are disposed in opposing pairs with one bearing member of each pair being carried by one of the drive chains 32, 34 and with each one of the plungers 42 being movably supported by a pair of the bearing members 44, so that the plunger 42 may be reciprocally moved toward and away from the first conveyor 12.

Mounted on the extremity of each plunger 42 is a pliable cleaning head 46 which is dimensioned to engage the inner periphery of each can 26. Preferably, the pliable cleaning head 46 comprises a soft rubber material strengthened by a fabric.

In accordance with the present invention, the second conveyor assembly is provided with means for driving the plungers 42 toward, through and away from the cans 26. In the preferred embodiment of the present invention, this means comprises a cam race 48 which is substantially parallel to, and in the plane of the second conveyor assembly defined by the endless drive chains 32, 34. The cam race 48 is defined by a relatively wide, flat cam race plate 50 positioned between the extremities of the second conveyor assembly, and supported by the frame 40. As shown in FIG. 1, the cam race plate 50 includes the cam race 48 therein which bends inward toward the first conveyor 12. The cam race 48 further includes a cam race loop 52 which partially encircles the ends of the second conveyor assembly, and joins with the cam race plate 50. As further shown in FIG. 1, the cam race 48 extends along the cam race plate 50 and communicates with the same cam race 48 as it passes along the cam race loop 52. It will be understood that the cam race 48 is endless in its passage about the second conveyor assembly. In order to facilitate movement of each plunger 42 toward, through and away from the can 26, each plunger is provided with a roller 54 which extends into and engages the cam race 48.

As has been described above, it will be understood that the relative spacing between the adjacent plungers 42 may be adjusted by moving adjacent bearing members 44 along the respective one of the endless drive chains 32, 34; and in the same manner, the relative index spacing between adjacent spindles 24 on the chain link belts 14 of the first conveyor 12 may be changed to conform with the size of the can 26 being cleaned. In order to facilitate this, the chain link belt 14 and the drive chains 32, 34 preferably have a uniform spacing between adjacent links in each chain.

Operation of the apparatus 10 will now be described with reference to FIG. 1.

Initially, the cans 26 to be cleaned are fed onto the first conveyor 21 by the screw 28. As the cans are fed onto the first conveyor 12, they are passed underneath the grid 29 and between adjacent one of the spindles 24, the grid 29 serving to hold lightweight cans, such as composite cans, onto the conveyor 12 during the cleaning operation.

The motor 20 rotates the drive chain 22 and thus the drive shaft 18. Rotation of the drive shaft 18 causes a concurrent rotation of the drive sprocket 16 associated with the first conveyor 12 and the drive sprocket 38 associated with the endless drive chains 32, 34 of the second conveyor assembly. As noted above, the drive chains 32 and 34, as well as the endless link belts 14 of the first conveyor 12 have a uniform spacing between adjacent links. Thus, these belts and chains are positively rotated together about the respective sprockets 16, or 36, 38.

As the cans 26 are being moved along with the first conveyor 12, each can abuts one of the spindles 24. At the same time, all of the plungers 42 are being rotated about the respective sprocket 36, 38 by movement of the drive chain 32, 34. As each plunger approaches the top side of the second conveyor assembly, the associated roller 54 is cammed in the race 48 along the bend and toward the first conveyor 12. In this way, the associated plunger 42 and its corresponding cleaning head 46 is cammed toward and through a corresponding one of the cans 26. As is shown in FIG. 1, the bend of the cam race 48 recedes away from the first conveyor 12, and then into a uniform spacing about the cam race look 52. As the roller 54 passes along the receding portion of the bend of the cam race 48, each plunger 42 is withdrawn from the associated can 26 and is then moved away from the first conveyor 12.

As each cleaning head 46 moves through the respective one of the cans 26, any foreign or undesirable material within the can is pushed through the can and out the other end thereof. It will thus be understood that the cans 26 which pass off of the first conveyor 12, as shown on the left hand side of FIG. 1, have had any trim rings, or other foreign material removed therefrom.

We claim:

1. Apparatus for removing foreign and undesirable materials from a plurality of open-ended lengths of hollow tubing, said apparatus comprising:

a first conveyor for transporting said plurality of tubes in a first direction;

means for indexing said tubes on said conveyor in spaced, parallel relation with an open end of all of said tubes facing in a direction which is substantially transverse to said first direction;

a second conveyor positioned along said first conveyor;

drive means coupled for driving said first and second conveyors at a uniform rate in said first direction;

a plurality of plungers parallel to said cans and carried by said second conveyor; and means including camming means in the plane of said second conveyor for moving said plungers through said tubes during uniform movement of said first and second conveyors in said first direction.

2. The apparatus recited in claim 1 further comprising a pliable cleaning head mounted on the extremity of each of said plungers and dimensioned to engage the inner periphery of said tubes.

3. The apparatus recited in claim 1 wherein said camming means comprises a fixed cam race extending parallel with said second conveyor and having a bend therein in the direction of said conveyor, each said plunger including means engaging said cam race, whereby said plungers move toward and away from said first conveyor during movement with said second conveyor.

4. The apparatus recited in claim 3 wherein said first conveyor comprises an endless conveyor.

5. The apparatus recited in claim 4 wherein said tube indexing means comprises a plurality of spaced spindles fixed to said first conveyor, each spindle adapted to engage one of said tubes during movement with said first conveyor.

6. The apparatus recited in claim 5 further comprising stationary holding means spaced from said first conveyor for holding said tubes thereon.

7. The apparatus recited in claim 6 wherein said holding means comprises a grid overlying said first conveyor.

8. The apparatus recited in claim 6 wherein said second conveyor comprises an endless conveyor.

9. The apparatus recited in claim 8 wherein said drive means comprises a positive drive mechanism coupled to both said first and second conveyors.

10. The apparatus recited in claim 9 wherein said cam race comprises an endless cam race plate in the plane of said second, endless conveyor.

11. The apparatus recited in claim 10 wherein said second conveyor comprises:

a pair of spaced, endless drive chains;

plural bearing members removably fixed along each endless drive chain, said bearing members being disposed in opposing pairs with one bearing member of each pair being carried by one of said drive chains; and wherein each one of said plungers is movably supported by one of said pairs of bearing members so as to be reciprocally movable toward and away from first conveyor.

12. The apparatus recited in claim 11 wherein said cam race plate is disposed between said two drive chains of said second, endless conveyor, and wherein said means with each said plunger for engaging said cam race comprises a roller fixed to each said plunger between the corresponding pair of said bearing members, said roller extending into and engaging said cam race.

13. The apparatus recited in claim 11 wherein said first conveyor comprises at least one endless chain link belt and wherein the spacing between adjacent links in said belt is substantially uniform to the spacing between adjacent lengths in said pair of spaced, endless drive chains of said second conveyor.

14. The apparatus recited in claim 13, wherein said indexing spindles are removably joined to said chain link belt.

15. The apparatus recited in claim 11, wherein said first conveyor comprises an endless drive chain having a link length and spacing corresponding to that of said second conveyor.

16. Apparatus for removing foreign and undesirable materials from a plurality of open-ended lengths to hollow tubing, said apparatus comprising:

a first conveyor for transporting said plurality of tubes in a first direction;

means for indexing said tubes on said conveyor in spaced, parallel relation with one end of all of said tubes facing in a direction which is substantially transverse to said first direction;

a second conveyor positioned alongside said first conveyor;

positive drive means coupled for driving said first and second conveyors at a uniform rate in said first direction;

a cam race in the plane of said second conveyor;

a plurality of plungers movably supported by said second conveyor and parallel with said tubes, said plungers coupled with said cam race; and wherein said cam race contains a bend therein in a direction towards said first conveyor to permit each said plunger to move through one of said tubes.

17. The apparatus recited in claim 16 further comprising:

a pair of spaced, endless drive chains;

plural bearing members fixed along each endless drive chain, said bearing members being disposed in opposing pairs with one bearing member of each pair being carried by one of said drive chains; and each one of said plungers being removably supported by one of said pairs of bearing members so as to be reciprocally movable toward and away from said first conveyor.

18. The apparatus recited in claim 16 wherein said cam race comprises a cam race plate in the plane of said second conveyor, and a cam race loop forming an endless cam race with said cam race plate.

19. The apparatus recited in claim 16 further comprising means for indexing the position of said plunger with the corresponding position of said tubes, as determined by said tube indexing means.

20. Apparatus for removing foreign and undersirable materials from a plurality of open-ended lengths of hollow tubing, said apparatus comprising:

a conveyor for transporting said plurality of tubes in a first direction;

means for indexing said tubes on said conveyor and spaced, parallel relation with an open end of all of said tubes facing in a direction which is substantially transverse to said first direction;

a pair of spaced, endless drive chains alongside of said first conveyor;

drive means coupled for driving said conveyor and said drive chain at a uniform rate;

plural bearing members fixed along each endless drive chain, said bearing members being disposed in opposing pairs with one bearing member of each pair being carried by one of said drive chains;

a plurality of plungers parallel with said tubes, each plunger movably supported by one of said pairs of bearing members;

a pliable cleaning head mounted on the extremity of each of said plungers and dimensioned to engage the inner periphery of said tubes;

means for moving said plungers through said tubes during uniform movement of said conveyor with said endless drive chain to permit said plungers to remove said foreign and undesirable materials from said tubes; and wherein said moving means comprises a cam race between said two drive chains, each of said plungers further including means engaging said race.

* * * * *